US011352786B2

(12) United States Patent
Rahimian et al.

(10) Patent No.: US 11,352,786 B2
(45) Date of Patent: Jun. 7, 2022

(54) CONSTRUCTING BUILDINGS WITH MODULAR WALL STRUCTURE

(71) Applicant: WSP USA, Inc., New York, NY (US)

(72) Inventors: Ahmad Rahimian, New York, NY (US); Konstantin Udilovich, New York, NY (US); Jeffrey Smilow, New York, NY (US); Mohammed M. Haque, New York, NY (US)

(73) Assignee: WSP USA, INC., New York, NY (US)

( * ) Notice: Subject to any disclaimer, the term of this patent is extended or adjusted under 35 U.S.C. 154(b) by 0 days.

(21) Appl. No.: 16/993,957

(22) Filed: Aug. 14, 2020

(65) Prior Publication Data

US 2021/0054624 A1 Feb. 25, 2021

Related U.S. Application Data

(60) Provisional application No. 62/888,625, filed on Aug. 19, 2019.

(51) Int. Cl.
*E04B 2/62* (2006.01)
*E04B 1/04* (2006.01)
(Continued)

(52) U.S. Cl.
CPC ..... *E04B 2/62* (2013.01); *E04B 1/043* (2013.01); *E04B 1/61* (2013.01); *E04C 2/06* (2013.01); *E04C 5/01* (2013.01); *E04C 5/125* (2013.01)

(58) Field of Classification Search
CPC . E04B 1/043; E04B 1/161; E04B 1/34; E04B 1/61; E04B 1/6145; E04B 2/62;
(Continued)

(56) References Cited

U.S. PATENT DOCUMENTS 2,670,819 A * 3/1954 Stanley ..... E04C 5/064 52/649.1
3,298,152 A * 1/1967 Lockshawjames ..... E04C 2/40 52/649.6
(Continued)

FOREIGN PATENT DOCUMENTS

EP 0164330 A2 12/1985
GB 2 529 688 A 3/2016
(Continued)

OTHER PUBLICATIONS

International Search Report and Written Opinion for application No. PCT/US2020/047032 dated Nov. 13, 2020.
(Continued)

*Primary Examiner* — James M Ference
(74) *Attorney, Agent, or Firm* — Robert P. Michal, Esq.; Carter, DeLuca & Farrell LLP

(57) ABSTRACT

A method of construction of composite wall module system in which a first wall module and a second wall module are coupled to the first wall module by a vertical joint. The vertical joint is comprised of plurality of anchors and reinforcement bars as well as steel side plates allowing composite wall steel faceplates to be discontinuous across the vertical joint. The faceplates of the first and second modules are not made continuous across the vertical joint through continuous welding. The vertical wall joint further includes fill disposed between faceplates and side plates adjacent to anchors and reinforcement bars.

18 Claims, 7 Drawing Sheets

(51) Int. Cl.

| | |
|---|---|
| ***E04C 5/12*** | (2006.01) |
| ***E04C 2/06*** | (2006.01) |
| ***E04C 5/01*** | (2006.01) |
| ***E04B 1/61*** | (2006.01) |

(58) Field of Classification Search
CPC ..... E04B 2/8647; E04B 2002/867; E04B 2002/8676; E04C 2/06; E04C 5/01; E04C 5/0645; E04C 5/125
See application file for complete search history.

(56) References Cited

U.S. PATENT DOCUMENTS 3,559,355 A * 2/1971 Day, Jr. ..... E04B 1/161 52/251
4,104,842 A * 8/1978 Rockstead ..... E04B 2/8617 52/309.12
4,125,981 A * 11/1978 MacLeod ..... E04B 1/161 52/309.12
4,418,463 A * 12/1983 McNeill ..... B28B 23/028 140/112
4,559,752 A * 12/1985 Kieffer ..... E04C 5/0636 52/309.7
5,216,860 A * 6/1993 Thomson ..... E04B 1/043 52/259
5,528,876 A * 6/1996 Lu ..... E04G 9/065 52/654.1
5,761,875 A * 6/1998 Oliphant ..... E04H 12/24 52/704
6,212,845 B1 * 4/2001 De Zen ..... E04B 2/8629 52/607
6,247,280 B1 * 6/2001 Grinshpun ..... E04B 2/8635 52/309.12
6,701,683 B2 * 3/2004 Messenger ..... E04C 2/044 52/309.11
6,898,908 B2 * 5/2005 Messenger ..... E04C 2/044 52/268
7,444,788 B2 * 11/2008 Morin ..... E04B 2/8641 52/425
7,703,248 B2 * 4/2010 Dincel ..... E04C 2/34 52/284
7,891,150 B2 * 2/2011 Finfrock ..... E04B 5/04 52/414
8,393,128 B2 * 3/2013 Klersy ..... E04B 1/34823 52/745.21
8,677,713 B1 * 3/2014 Sheehy ..... E04C 2/388 52/588.1
8,919,057 B1 * 12/2014 Dupray ..... E04B 5/36 52/223.14
9,850,658 B2 * 12/2017 Alcala Ordaz ..... E04B 2/8658
10,287,773 B2 * 5/2019 Taleb ..... E04B 2/8629
2003/0029111 A1 * 2/2003 Yabuuchi ..... E04C 3/293 52/425
2010/0212241 A1 * 8/2010 Holroyd ..... E04C 2/36 52/309.4
2012/0047816 A1 * 3/2012 Zhong ..... E04B 1/164 52/11
2012/0233936 A1 * 9/2012 Zhong ..... E04B 1/165 52/173.1
2015/0132535 A1 * 5/2015 Hazenbrink ..... E04B 1/19 428/137
2015/0159372 A1 * 6/2015 Lee ..... E04B 2/562 52/426
2015/0275531 A1 * 10/2015 Alcala Ordaz ..... E04B 2/8658 249/189
2016/0108619 A1 * 4/2016 Buzimkic ..... E04C 5/0604 52/719
2018/0135299 A1 * 5/2018 Taleb ..... E04B 2/8652
2018/0347176 A1 * 12/2018 Cho ..... E04B 1/34363
2020/0123768 A1 * 4/2020 Niepceron ..... E04B 2/8635
2020/0378117 A1 * 12/2020 Giles ..... E04B 2/62
2021/0054624 A1 * 2/2021 Rahimian ..... E04B 1/043

FOREIGN PATENT DOCUMENTS

JP 2000170285 A 6/2000
JP 2013014944 A 1/2013

OTHER PUBLICATIONS https://www.aisc.org/why-steel/innovative-systems/SpeedCore/.
International Preliminary Reporton Patentability for application No. PCT/US2020/047032 dated Feb. 17, 2022.

* cited by examiner

CONSTRUCTING BUILDINGS WITH MODULAR WALL STRUCTURE

CROSS REFERENCE TO RELATED APPLICATIONS

This application claims the benefit of U.S. Provisional Patent Application No. 62/888,625, filed Aug. 19, 2019, the entire contents of which are incorporated by reference herein.

TECHNICAL FIELD

This disclosure relates to building construction, and more particularly, to mid-rise to high-rise building construction including modular wall structure such as composite structural steel, concrete, and other building materials.

BACKGROUND

Many conventionally built mid-rise and high-rise buildings utilize cast-in-place reinforced concrete walls (also referred to as shear walls) around elevators, stairs, and interior support spaces, typically at the center of building floor plate. This system of shear walls is often referred to as the building core. Shear walls are normally constructed with reinforcement bar cages inside monolithic concrete walls that are poured, in-situ, into a temporary formwork. Commercial buildings are typically constructed using structural steel framing installed around the cast-in-place reinforced concrete core. Structural steel framing is comprised of hot-rolled and built-up steel columns and beams. Floors are constructed using a composite metal deck field-attached to steel beams via welds or anchorage devices and filled with concrete in-situ.

The combination of cast-in-place shear walls and structural steel framing creates significant challenges during building construction. For instance, reinforced concrete walls and structural steel framing cannot be installed at the same time due to the way concrete formwork interferes with structural steel framing. This creates logistical challenges where either steel or concrete has to be erected earlier than the other system. If structural steel is constructed before reinforced concrete, costly erection stability bracing is required. Further, construction tolerances in concrete construction are greater in concrete than they are in the steel construction. This results in field fit-up challenges for the steel erector when reinforced concrete walls are constructed earlier than structural steel at any given floor. In addition, the speed of construction of any given floor is limited by the speed of building reinforcement cages and formwork in-situ. Because construction of cast-in-place concrete shear walls utilizes off-site prefabrication to a smaller degree than structural steel construction, the combination of cast-in-place shear walls and structural steel results in longer construction time for any given floor of the building.

In an attempt to remedy such challenges, a system termed as SpeedCore has been proposed by the American Institute of Steel Construction (AISC). The SpeedCore system utilizes steel plate modules, fabricated off-site for a composite shear wall construction. The primary structural components of the steel plate modules are steel faceplates connected via series of steel rods, called ties. The ties are welded or mechanically connected to face plates at the time when the modules are fabricated. The steel plate modules are transported to the building site and erected using conventional structural steel methods. Adjacent steel-plate modules are welded together, in-situ, to provide continuity of steel plate material. After the modules are erected and welded at any given floor or tier of the building, the space between faceplates is filled with concrete. After the concrete cures and gains the design strength, steel plates and concrete fill work together as one structural element to resist vertical (gravity) loads as well as lateral (wind and seismic) loads. The presence of regularly-spaced cross ties ensures that internal forces resulting from imposed loads are shared between concrete infill and faceplates. The main advantages of the SpeedCore system include the elimination of temporary concrete formwork, the elimination of field-constructed reinforcement cages, consistent tolerances and construction methods between the core and steel framing around it, and the elimination of temporary erection bracing.

However, the SpeedCore system has significant disadvantages limiting its usefulness in many mid-rise and high-rise building applications. In particular, the SpeedCore system requires a large amount of in-situ welding between steel plate modules, which also prolongs construction timelines. Further, field welding is costly due to the requirement for high-skilled labor (often scarce in many markets) and the requirement for continuous inspection of welds required by building codes. In addition, field welds placed both horizontally and vertically require an increased level of precision during the fit-up of pre-fabricated plate modules at the time they are erected in the field. Such a high-level of precision increases the cost of construction and reduces the speed at which the modules are erected.

SUMMARY

This disclosure provides improved building construction systems and methods of erection that greatly minimize the amount of field welding required to construct buildings. Advantageously, these systems and methods significantly reduce construction costs and increase the speed of building construction.

This disclosure provides a significant improvement in the speed of construction of a composite plate wall system by eliminating many field-welded connections between modules (e.g., steel plate modules that are at least partially prefabricated). This disclosure also provides a more economical way to achieve structural continuity between adjacent modules by requiring a much smaller amount of welding performed in-situ.

In aspects, this disclosure is directed to a method of in-situ connection of wall modules by a combination of horizontal field-welded joints, vertical joints utilizing a field-bolted connection, and vertical joints where load transfer occurs through infill concrete and either shear anchors or reinforcement bars.

In some aspects of this disclosure, a composite building construction system includes double steel plate modules with concrete infill.

In certain aspects of this disclosure, wall modules in the form of double steel plate modules include two parallel faceplates connected with multiple cross-ties. The cross-ties are oriented normal to surfaces of the faceplates and are spaced at a regular interval in both vertical and horizontal directions. Side plates are welded to both faceplates in the vicinity of vertical joints or vertical end terminations of the wall modules. The side plates may be solid or perforated. The side plates provide stability to the un-filled plate module during shipping and erection. They are also a part of vertical joint construction.

In many building applications, the full development of plate strength via in-situ welding in vertical joints between adjacent wall modules can be replaced by a connection where the faceplates can be discontinuous across vertical joints. Force transfer between horizontally adjacent wall modules can be achieved via field-bolted connection and/or additional devices supported within the body of concrete.

Field-bolted connections may be constructed by providing shop-welded faceplate attachments such as rolled steel angles or a series of lapping plates with pre-drilled bolt holes. During the erection of the wall modules, field-bolted connections can be utilized for accurate placement of partially pre-fabricated wall modules and to give the constructed structure stability for loads during construction and while concrete infill is poured into the wall module. After the infill concrete gains sufficient early strength, typically within hours after the pour, temporary bolted connections may be removed. If finishes and clearance to other building elements and construction permit, field-bolted connections may be left in place to provide supplementary strength required to resist loads imposed on the completed wall module.

In some cases, transfer of vertical shear stresses may be achieved by shop-welded steel headed stud anchors or shop-welded channel shear anchors. Steel headed anchors can be welded to the vertical side plates of each wall module at a regular spacing. The vertical side plates are shop-welded to faceplates on both sides, both for load transfer within the joint and for additional rigidity of the wall modules. The side plates may be set back from an edge of the wall module, forming a space or cavity between adjacent side plates of adjacent wall modules before concrete placement. Steel headed stud anchors are oriented normal to side plates on one or both sides of the plates in order to facilitate force-transfer between adjacent modules through site-cast concrete in the space between side plates. In cases of high demand on the structural strength of a vertical joint between adjacent wall modules, a special concrete mix can be placed in the space between the adjacent side plates of the adjacent wall modules. An appropriately designed high-strength concrete mix allows for higher ductility and strength of the vertical joint. When high ductility and strength are not required, the concrete mix which is used for concrete in the space between the side plates can be identical to the concrete mix utilized for the fill between the faceplates in the main space separate from the space between the adjacent side plates. In such cases, the side plates can have large openings that enable concrete to flow into the space between the side plates, thus simplifying concrete placement operation.

In some cases, the transfer of vertical shear stresses may be achieved by reinforcing bars horizontally disposed and vertically spaced with respect to one another along the vertical joint between horizontally adjacent wall modules. The reinforcing bars pass through the space between side plates and extend into the concrete fill space for a distance sufficient to fully engage reinforcement strength by virtue of being embedded into the concrete (e.g., embedment length of reinforcing bars). The reinforcing bars may be pre-installed in one of the horizontally adjacent wall modules. Each reinforcement bar can be placed inside the wall module in order to reduce shipping dimensions of the wall module. The reinforcement bars can be shop-installed through holes/openings defined in the side plates of the wall modules and can be temporarily attached for shipping and erection. After adjacent wall modules are erected, the reinforcing bars are positioned into their final location by sliding them horizontally. The bars can be accessed using temporary access openings in the faceplates. After the reinforcement bars are positioned in their final location, the temporary access openings can be sealed in order to prevent poured concrete from leaking. After concrete fill is placed in the wall modules, the horizontal reinforcement bars crossing the plane of the vertical joint provide force transfer through the concrete in the vertical joint zone. The reinforcement bars can be headed, hooked, or have mechanical anchorage devices in order to provide a shorter concrete embedment length. Shorter reinforcement bar embedment length disposed in adjacent modules facilitates easier installation of wall modules. In aspects, the side plates of wall modules are shop-welded to the faceplates along the edges. The side plates may be perforated to enable concrete to flow around the reinforcement bars or can be fabricated by cutting and re-welding plates to reduce material waste.

When a different concrete mix is utilized in a load transfer zone at the vertical joint between adjacent modules for improved tensile strength and ductility, ultra-high-performance concrete (UHPC) can be poured into the load transfer zone. UHPC improves mechanical properties of concrete to provide higher shear strength and ductility of the vertical joint.

In some cases, the transfer of vertical shear between horizontally adjacent wall modules is achieved through concentrated reinforcement bars placed in groups where such bars intersect a vertical plane of force transfer at an angle. The reinforcement bars may be straight or pre-bent in a zigzag shape. The reinforcement bars are placed in the force transfer zone where the force in the concrete between side plates has steel headed stud anchors that enable the transfer of shear force from the plates and concrete outside of the vertical joint to the reinforcing bars in the joint zone. The reinforcing bars are placed in close proximity to anchors. Further transfer of shear force through a shear-friction mechanism is possible once the reinforcing bars are engaged. To allow for full engagement of reinforcing bars, lap splices are used between reinforcing bars in vertically adjacent modules. The reinforcing bars are placed in-situ after unfilled steel modules are erected and before the concrete fill is placed.

In some cases, the transfer of vertical shear between adjacent wall modules is achieved through horizontal reinforcement bars concentrated in groups at the top and bottom of the wall modules. The horizontal reinforcement bars are embedded into concrete to develop full or partial tensile strength of the reinforcement on each side of the vertical joint. The transfer of shear force is achieved by a shear friction mechanism. The lower group of bars at the bottom of a wall module is placed in-situ before the wall modules are erected. Reinforcement is placed above the previously placed concrete. The side plates of the wall module define a special cut-out to facilitate placement of the wall modules on top of the previously placed reinforcement bars. The upper group of reinforcing bars is placed after the wall modules are erected in-situ. The special cut-outs in side plates enable an easier installation of the horizontal reinforcement bars.

Where concentrated reinforcement is used to transfer shear forces between horizontally adjacent wall modules, the mechanism utilizing reinforcement placed at an angle to the vertical joint plane and the mechanism utilizing groups of concentrated at the top and bottom of wall panels can be used separately or in combination. In cases where the two mechanisms are combined, individual contributions of each of the mechanisms to the overall resistance of the joints are added to achieve increased strength.

According to one aspect of this disclosure, a wall module system includes a first wall module and a second wall module connected to the first wall module by a vertical joint. The first wall module includes a first pair of faceplates, a first set of cross-ties extending between the first pair of faceplates, and a first side plate extending between the first pair of faceplates. The second wall module includes a second pair of faceplates, a second set of cross-ties extending between the second pair of faceplates, and a second side plate extending between the second pair of faceplates. The faceplates of the first and second modules are not made continuous across the vertical joint through continuous welding. The wall module system further includes fill disposed between the first and second pairs of faceplates.

In aspects of this disclosure, the fill may include concrete.

In various aspects of this disclosure, one or both of the first or second side plates may include a plurality of anchors extending transversely therefrom.

In certain aspects of this disclosure, the first cross-ties may be shop-welded or mechanically anchored to the first pair of faceplates. The second cross-ties may be shop-welded or mechanically anchored to the second pair of faceplates.

In aspects of this disclosure, angles, plates or similar connection elements may be secured to the first and second pairs of faceplates to couple the first and second wall modules together. At least some of the angles may be secured together by a nut and bolt assembly.

In some aspects of this disclosure, at least one of the first or second side plates may define a plurality of perforations therethrough for receiving a plurality of reinforcement bars. Reinforcement bars may extend through the plurality of perforations. At least one of the first or second side plates may further define an opening therethrough separate from the plurality of perforations. The opening may be positioned to enable the fill to pass therethrough. At least one of the faceplates of the first pair of faceplates may define an access opening therethrough that provides access to the reinforcement bars.

In aspects of this disclosure, the fill may include a first fill disposed in a fill cavity defined between the first and second wall modules along the vertical joint. The fill may include a second fill that has different properties than the first fill. The second fill may be disposed adjacent to at least one of the first or second sets of cross-ties.

In some aspects of this disclosure, a third and/or subsequent wall module may be coupled to the second wall module. The third wall module may be transverse to the second wall module. The subsequent wall module may include an end termination plate.

In certain aspects of this disclosure, the first side plate may be an inner side plate, and wherein the first wall module may further include an outer side plate. The inner and outer side plates may include steel headed stud anchors extending transversely therefrom.

In some aspects of this disclosure, a plurality of vertical reinforcement bar assemblies may be supported in the vertical joint between the first and second wall modules. Each vertical reinforcement bar assembly or the plurality of vertical reinforcement bar assemblies may have an inclined angle similar to a fixed scissor lift-type structure with a plurality of interconnected straight and angled segments.

In aspects of this disclosure, a plurality of top reinforcement bars may be positioned near the top surface of the first and second wall modules and a plurality of bottom reinforcement bars may be positioned in vertical registration with the plurality of top reinforcement bars near the bottom surface of the first and second wall modules.

Other aspects, features, and advantages will be apparent from the description, the drawings, and the claims that follow.

BRIEF DESCRIPTION OF DRAWINGS

The accompanying drawings, which are incorporated in and constitute a part of this specification, illustrate aspects of the disclosure and, together with a general description of the disclosure given above and the detailed description given below, serve to explain the principles of this disclosure, wherein.

DETAILED DESCRIPTION

Figure 1:
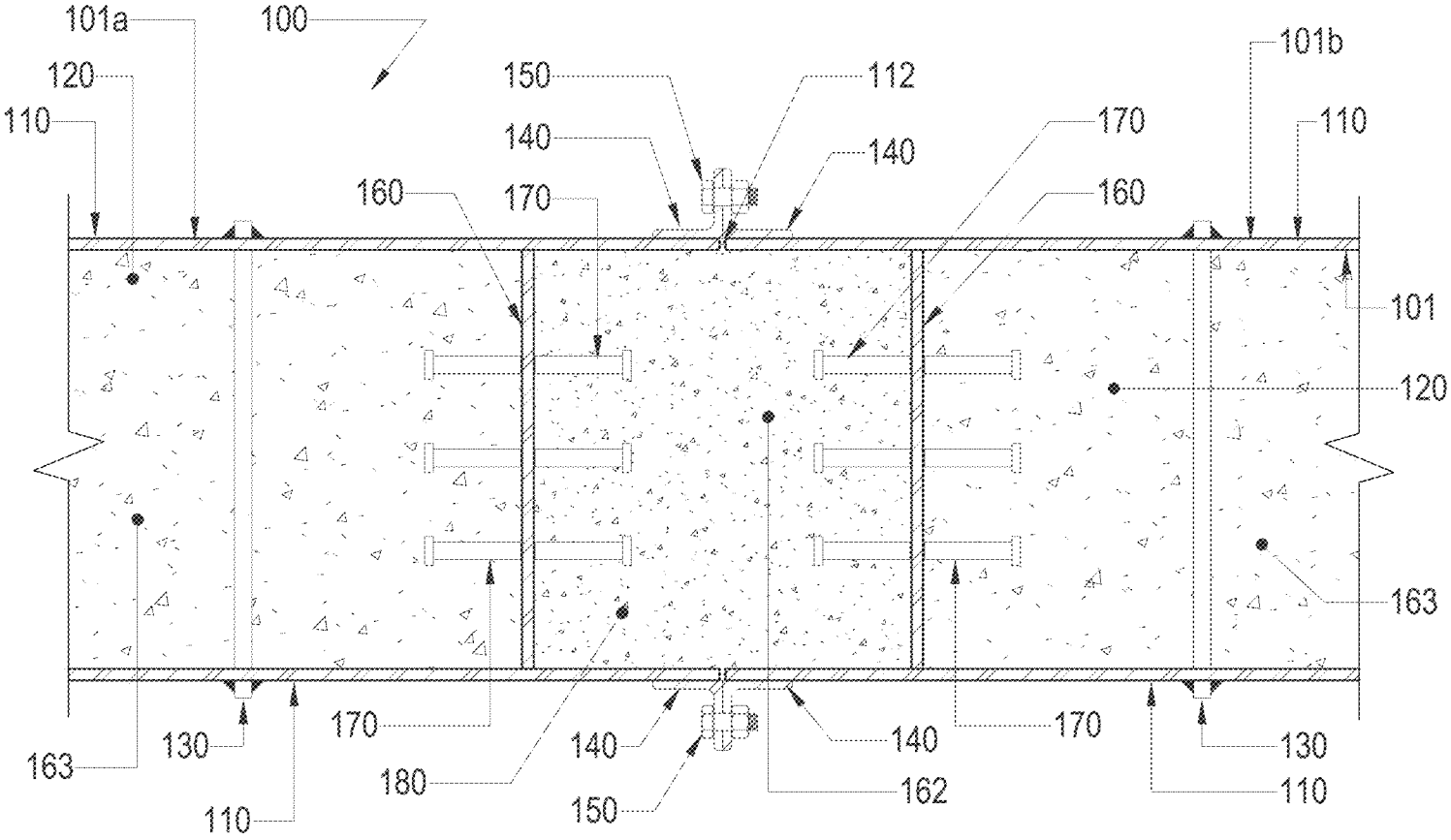
FIG. 1 is a plan, cross-sectional view of a portion of one embodiment of a wall module system in accordance with the principles of this disclosure.

Aspects of the disclosed structure and methods are described in detail with reference to the drawings, in which like reference numerals designate identical or corresponding elements in each of the several views. Additionally, the term "proximal" refers to the portion of structure that is closer to the user and the term "distal" refers to the portion of structure that is farther from the user. In addition, directional terms such as front, rear, upper, lower, top, bottom, and the like are used simply for convenience of description and are not intended to limit the disclosure attached hereto.

In the following description, well-known functions or constructions are not described in detail to avoid obscuring the present disclosure in unnecessary detail.

Turning to FIG. 1, a wall module system 100 includes wall modules 101, such as adjacent wall modules 101*a*, 101*b* that define a vertical joint 112 therebetween. Wall modules 101 have faceplates 110, which may be steel, fill 120 supported in an outer fill cavity 163 between faceplates 110, which may be concrete, and cross ties 130 that are secured to faceplates 110 on opposite sides of wall module 101. Cross ties 130 may be welded or mechanically anchored to faceplates 110 in a shop, and may be in the form of a rod. Wall module system 100 further includes shop-welded angles 140 secured to faceplates 110, which may be continuous or intermittent, and a field-installed nut and bolt assembly 150 that connects a pair of shop-welded angles 140 together for coupling adjacent wall modules 101*a*, 101*b* together across vertical joint 112. Wall module system 100 further includes side plates 160 (e.g., shop-welded) that extend between faceplates 110, and which may be continuous or perforated. Wall module system 100 also includes a plurality of steel headed stud anchors 170 (e.g., shear studs) that extend normal to the surface of side plates 160 on one or both sides and are disposed in spaced-apart arrangement within an inner fill cavity 162 defined between side plates 160 and adjacent wall modules 101*a*, 101*b*. Inner fill cavity 162 supports fill 180 therein to solidify structure of wall module system 100 into a solid unitary system. Fill 180 may be concrete, and may have the same and/or different properties as fill 120.

Figure 2:
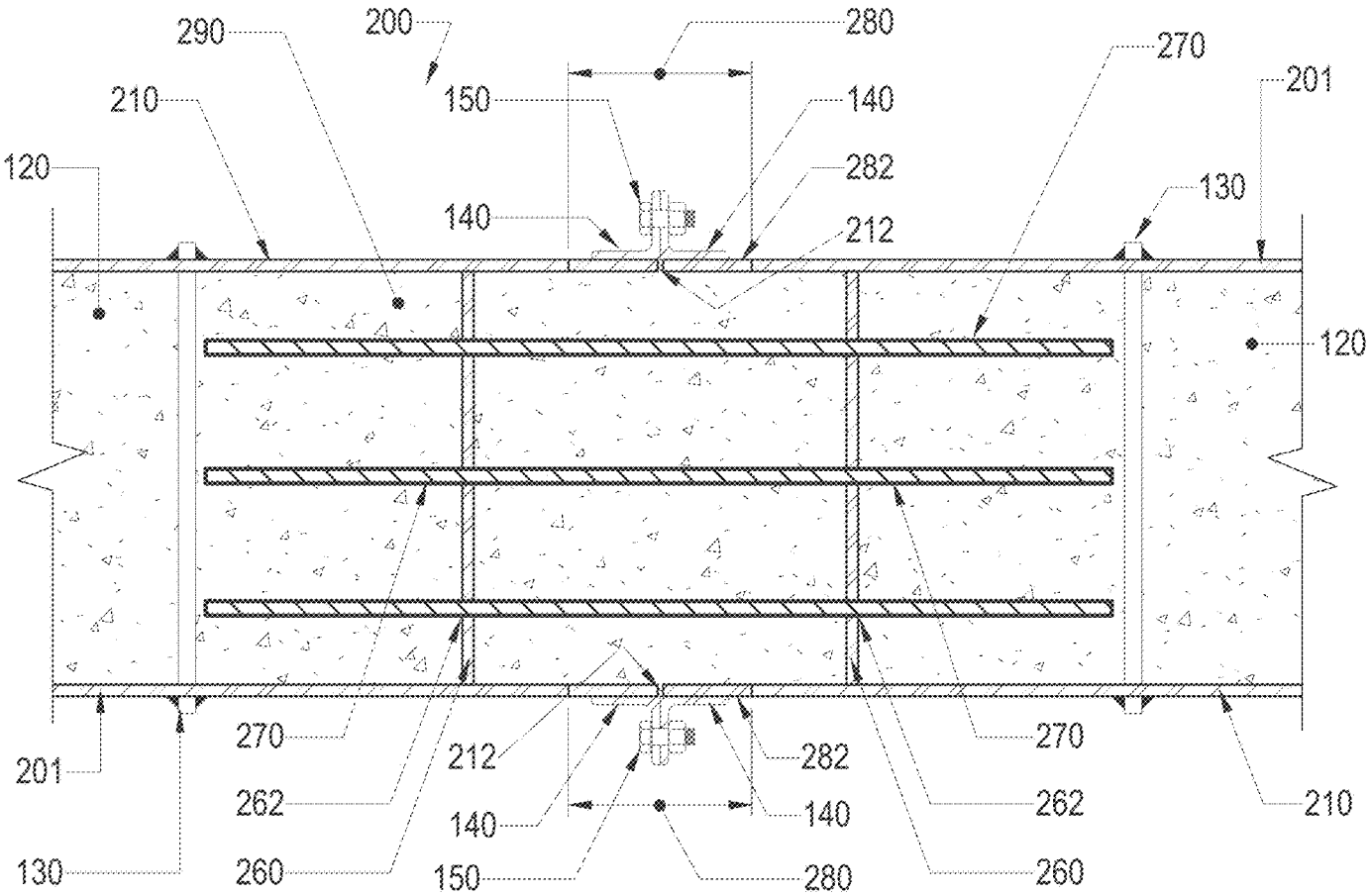
FIG. 2 is a plan, cross-sectional view of a portion of another embodiment of a wall module system in accordance with the principles of this disclosure.

With reference to FIG. 2, a wall module system 200 includes wall modules 201 coupled together at a vertical joint 212. Wall modules 201 have faceplates 210, fill 120 supported between faceplates 210, and cross ties 130 secured to faceplates 210 on opposite sides of vertical joint 212. Wall module system 200 further includes shop-welded angles 140 secured to faceplates 210 and a field-installed nut and bolt assembly 150 that connects shop-welded angles 140 together. Wall module system 200 also includes side plates 260 that extend vertically between faceplates 210 and define a plurality of perforations 262 therethrough for receiving reinforcement bars 270 therethrough. Reinforcement bars 270, may be in the form of a reinforcing bar lap splice arrangement. Each reinforcement bar 270 may be straight, headed, hooked, or have any other suitable geometric configuration. Wall module system 200 further includes an access opening 280 defined in faceplates 280 for positioning reinforcement bars 270 therethrough (in-field) and securing reinforcement bars 270 to side plates 260. Access opening 280 is sealed before fill 120 is positioned within a fill cavity 290 defined between faceplates 210. Fill cavity 290 is positioned to receive fill 120 therein for solidifying structure of wall module system 200 into a solid unitary system. Once fill 120 is filled within fill cavity 290, access opening 280 can be sealed shut with a faceplate segment or alternative means 282 that covers access opening 280.

Figure 3:
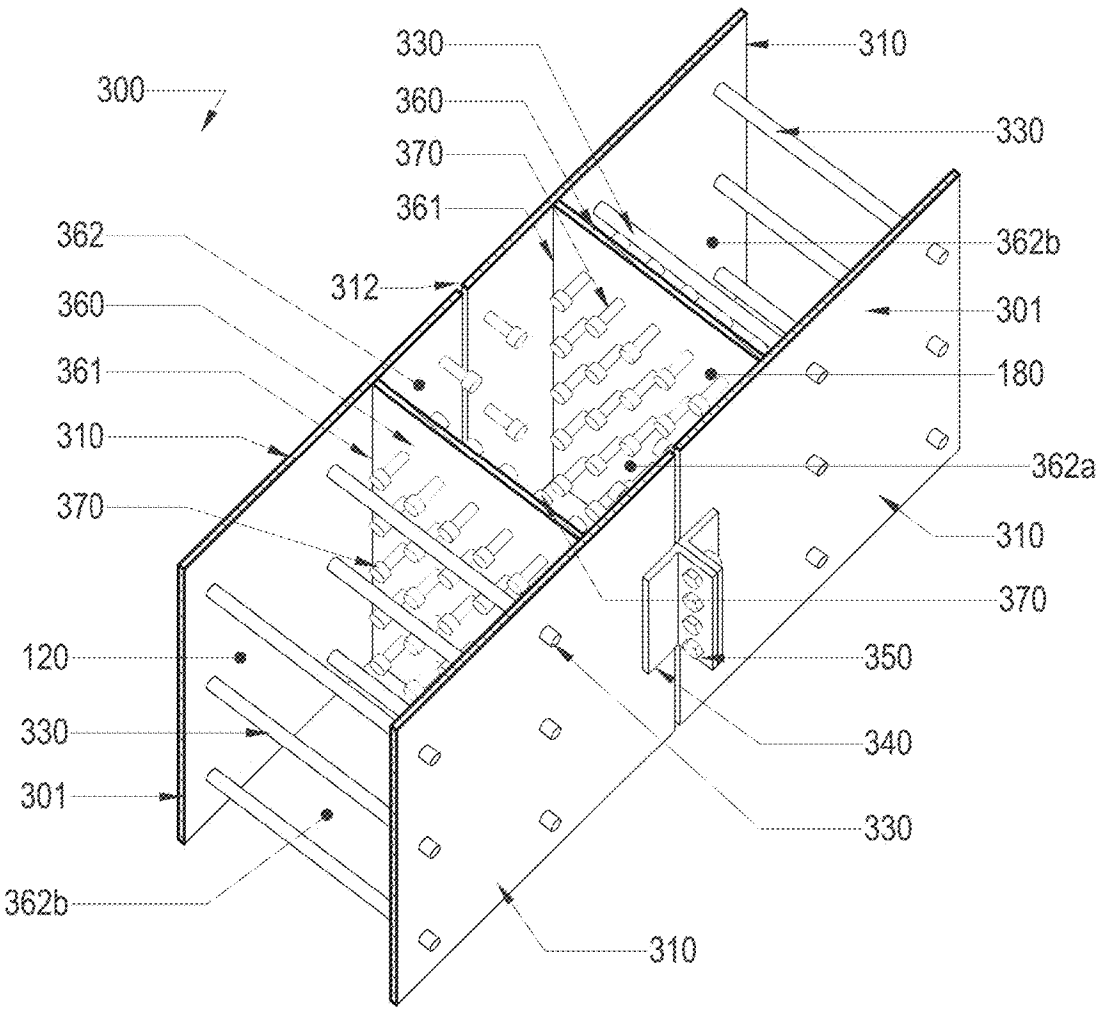
FIG. 3 is a axonometric view of still another embodiment of a wall module system in accordance with the principles of this disclosure, the wall module system having fill portions thereof removed for clarity.

Referring now to FIG. 3, a wall module system 300 is similar to wall module system 100 and includes wall modules 301 that define a vertical joint 312 therebetween. Wall modules 301 have faceplates 310, fill 120, 180 (see FIG. 1) supported between faceplates 310. Wall modules 301 also include cross ties 330 that are secured to faceplates 310 on opposite sides of wall module 301. Although each wall module 301 is shown with two columns and three rows of cross-ties 330, cross-ties 330 may be provided in any number of rows and/or columns along wall module 301 with any suitable spacing between cross-ties 330. In aspects, cross-ties 330 may be disposed at one or more predetermined intervals, randomly dispersed, angled relative to one another, and/or parallel to one another. Wall module system 300 further includes shop-welded angles 340 secured to faceplates 310 and a nut and bolt assembly 350 that connects a pair of shop-welded angles 140 together for connecting adjacent wall modules 301 together across vertical joint 312. Wall module system 300 further includes side plates 360 that extend between faceplates 310. Side plates 360 are shop-welded to the faceplates via vertical welds 361. Wall module system 300 also includes a plurality of steel headed stud anchors 370 (e.g., shear studs) that extend from side plates 360 and placed on one or both faces of side plates and are disposed in spaced-apart arrangement within a fill cavity 362 defined between side plates 360 and adjacent wall modules 301. Fill cavity 362 supports fill (e.g., fill 120 or fill 180) therein to solidify structure of wall module system 300 into a solid unitary system. Fill cavity 362 may include an inner fill cavity 362*a* between inner surfaces of side plates 360 and one or more outer fill cavities 362*b* defined between faceplates 310 and outer surfaces of side plates 360.

Figure 4:
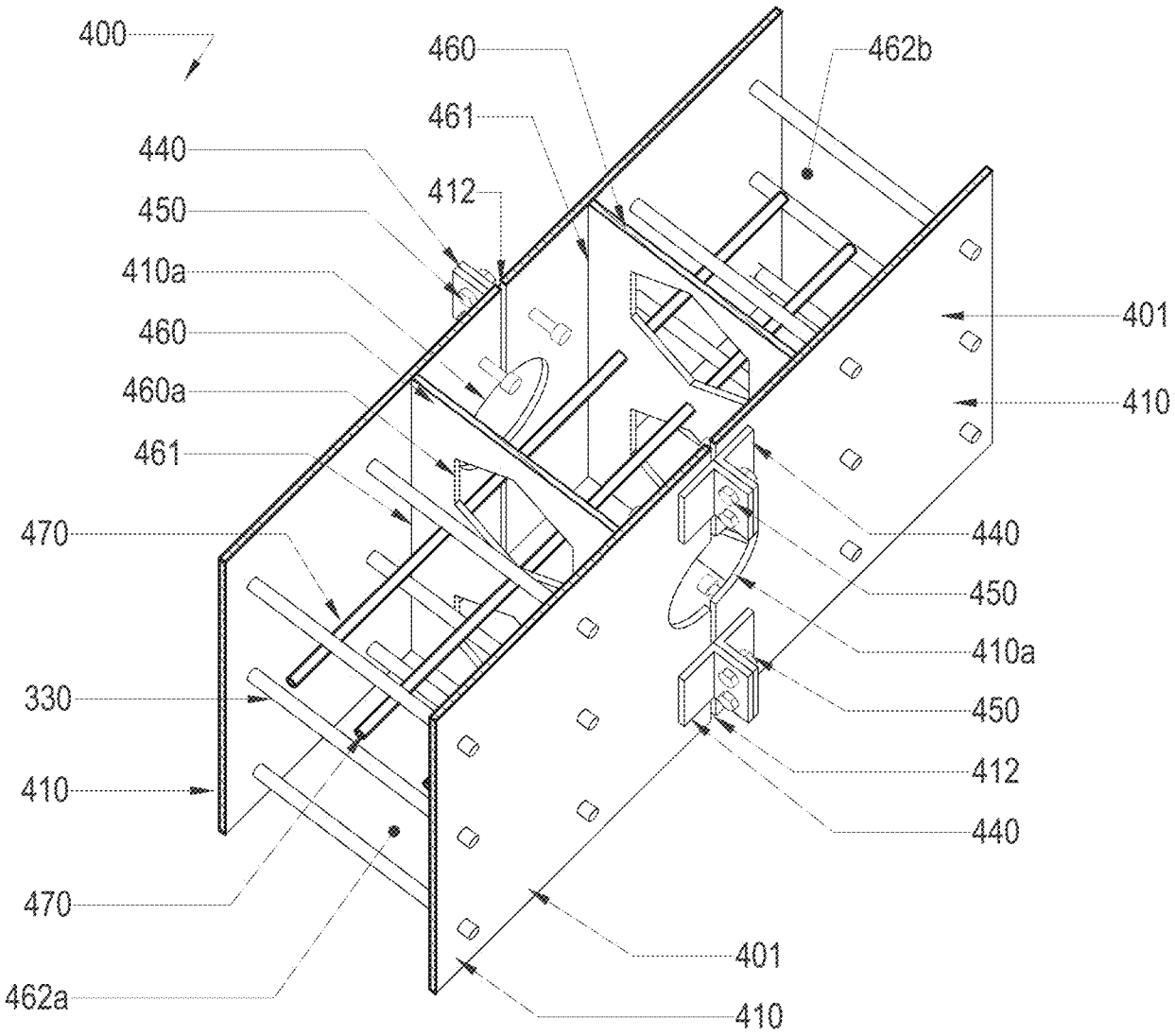
FIG. 4 is a axonometric view of yet another embodiment of a wall module system in accordance with the principles of this disclosure, the wall module system having fill portions thereof removed for clarity.

Turning now to FIG. 4, a wall module system 400 is similar to wall module systems 200 and 300 and includes wall modules 401 that define a vertical joint 412 therebetween. Wall modules 401 have faceplates 410 that define access openings or cut-outs 410*a* therein on one side thereof (e.g., vertical joint 412 side) for positioning of reinforcement bars 470 in the field (to be sealed before concrete placement with, for example, steel faceplate material). Wall modules 401 also support fill 120 (see FIG. 1) in inner and outer fill cavities 462*a*, 462*b* between faceplates 410. Wall modules 401 also include cross ties 330 that are secured to faceplates 410 on opposite sides of wall module 401. Wall module system 400 further includes shop-attached angles 440 secured to faceplates 410 and nut and bolt assemblies 450 that connect a pair of shop-welded angles 440 together for coupling adjacent wall modules 401 together across vertical joint 412. Wall module system 400 further includes side plates 460 that extend between faceplates 410. Side plates 460 are shop-welded to the faceplates via vertical welds 461. Side plates 460 define openings 460*a* therethrough and an inner fill cavity 462 therebetween. Although openings 460*a* are shown with a hexagonal configuration, openings 460*a* can have any suitable circular or non-circular configuration such as square, triangular, heptagon, octagon, etc. Side plates 460 further define a plurality of bar openings 460*b* therethrough for receiving reinforcing bars 470 therethrough. Reinforcing bars 470 may be parallel to one another and extend transverse to vertical joint 412.

Figure 5:
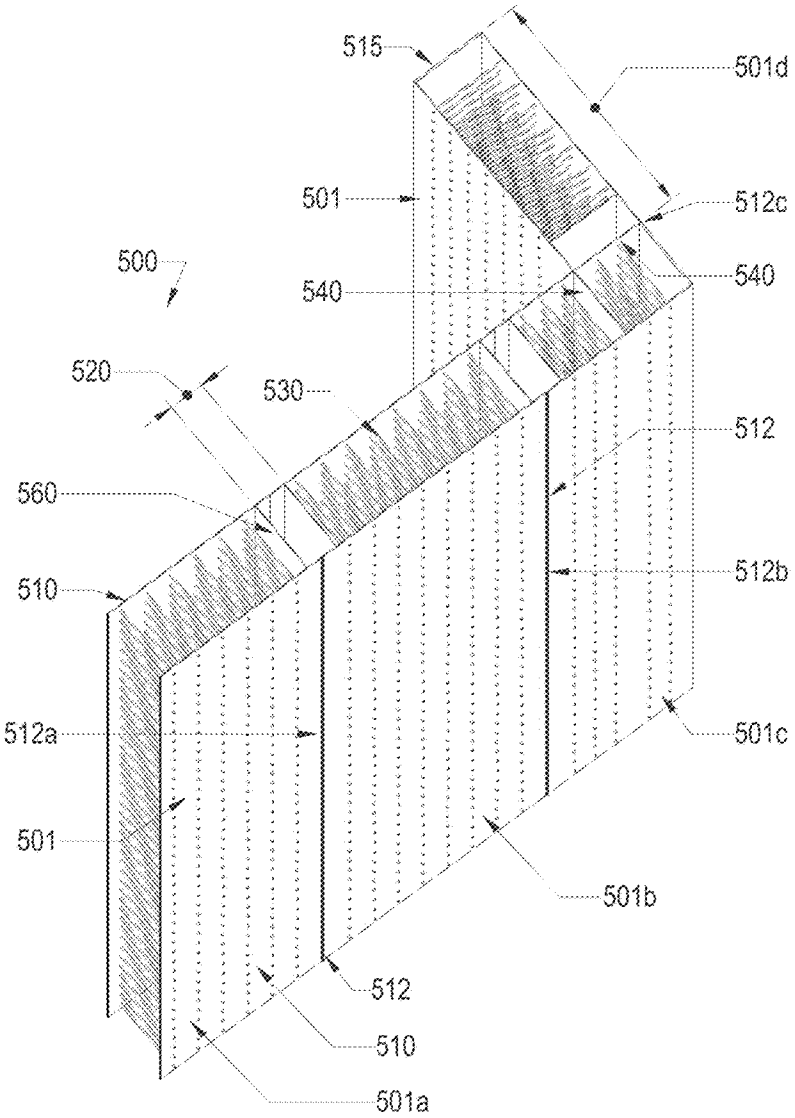
FIG. 5 is a axonometric view illustrating one wall module system in accordance with the principles of this disclosure.

With reference to FIG. 5, a wall module system 500 includes wall modules 501 such as wall modules 501*a*, 501*b*, and 501*c* that are coupled together via vertical joints 512 such as vertical joints 512*a*, 512*b*, and 512*c* to enable wall modules 501 to couple to one another in a parallel relation to one another (e.g., in lateral or side-by-side direction) and/or transverse to one another (e.g., perpendicular to one another such as wall modules 501*c*, 501*d*). Wall modules 501 can include a pair of faceplates 510 that are separated by any number and/or arrangement of cross-ties 530 and side plates 560. Similar to wall module systems 100-400, wall module system 500 is arranged to receive fill therein. Wall module system 500 can include a force transfer zone 520 having vertical joint 512 between adjacent wall modules 501. Wall modules 501, such as wall module 501*d* can include an end termination plate 515. At corner intersections, such as T-joints and L-joints additional side plates 540 may be required.

Figure 6:
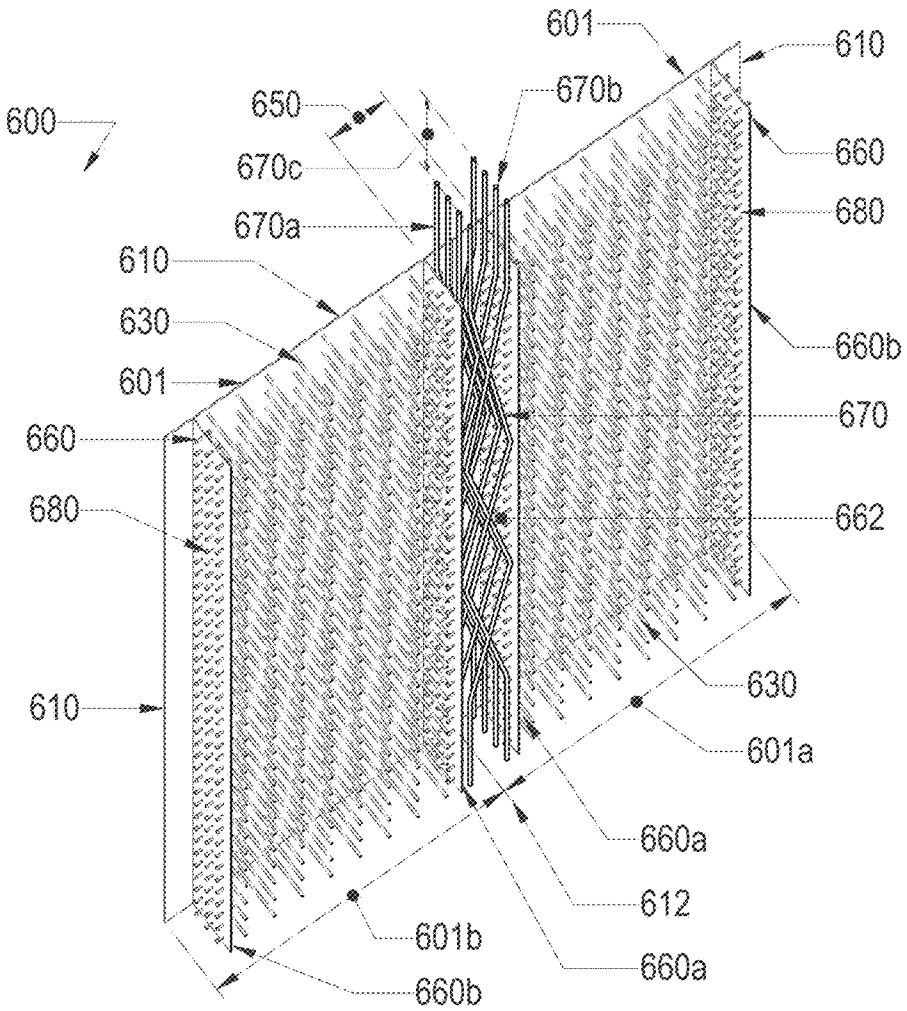
FIG. 6 is a axonometric cut-away view, where the front cutting plane passes through the middle surface of the wall module assembly, illustrating another wall module system in accordance with the principles of this disclosure, the wall module system having portions thereof removed for clarity.

Referring now to FIG. 6, a wall module system 600 includes wall modules 601 such as wall modules 601*a*, 601*b* that are coupled together via a vertical joint 612. Like the foregoing wall modules, wall modules 601*a*, 601*b* include faceplates 610 and side plates 660. Side plates 660 include side plates 660*a* and 660*b*, each of which includes steel headed stud anchors 680 on inner and/or outer surfaces thereof. Cross-ties 630 extend from faceplates 610. In this system, a plurality of vertical reinforcement bar assemblies 670 are supported in an inner cavity 662 along vertical joint 612 that is defined between inner surfaces of inner side plates 660*a* of adjacent wall modules 601 to form a force transfer zone 650. Each vertical reinforcement bar assembly 670 can include a plurality of straight and angled (e.g., pre-bent) segments 670*a*, 670*b* that form a fixed scissor lift-type structure (e.g., a zig-zag or wavelike shape) and includes a bar lap splice zone 670*c* for use between reinforcing bars in vertically adjacent wall modules. Although each segment is shown having a linear arrangement, each segment may have a curvilinear arrangement. Each vertical reinforcement bar assembly 670 can include a plurality of crossing points 670*d* where angled segments 670*b* intersect. Each vertical reinforcing bar assembly 670 is spaced-apart between faceplates 610 (e.g., in a front-to-back direction) relative to adjacent vertical reinforcing bar assemblies 670.

Figure 7:
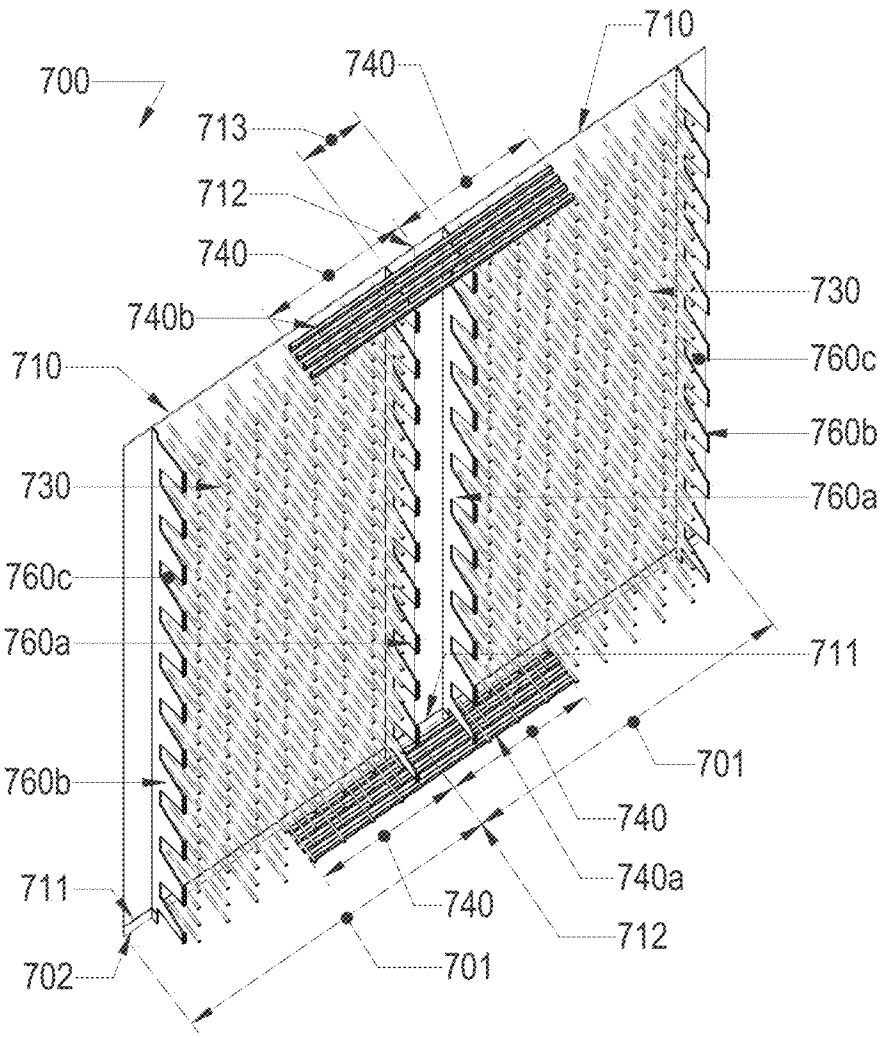
FIG. 7 is a axonometric cut-away view, where the front cutting plane passes through the middle surface of the wall module assembly, illustrating yet another wall module system in accordance with the principles of this disclosure, the wall module system having portions thereof removed for clarity.

With reference to FIG. 7, a wall module system 700 includes wall modules 701 that are coupled together via vertical joint 712. Wall modules 701 are positioned above wall modules 702 below along the horizontal joint 711. Wall module system 700 is similar to the foregoing wall module systems and includes faceplates 701 and cross-ties 730 that extend from faceplates 701. Wall module system 700 further includes side plates 760*a*, 760*b* that have a plurality of vertically spaced-apart openings 760*c*. A force transfer zone 713 is defined between side plates 760*a* of adjacent wall modules 701 along vertical joint 712. Wall module system 700 further includes a plurality of horizontal reinforcement bars 740*a* and 740*b*. Bottom reinforcement bars 740*a* are installed in situ before faceplates 701, cross-ties 730, and/or side plates 760*a*, 760*b*, which may be prefabricated together as unit (e.g., a steel module), are installed on top of bottom reinforcement bars 740*a*. Top reinforcement bars 740*b* are installed on top of the wall module system 700. The length of horizontal bars 740 is defined by a reinforcement bar embedment length in fill (e.g., concrete) extending laterally outward beyond the joint 712 on each side.

Persons skilled in the art will understand that the structures and methods specifically described herein and illustrated in the accompanying figures are non-limiting exemplary aspects, and that the description, disclosure, and figures should be construed merely as exemplary of particular aspects. It is to be understood, therefore, that this disclosure is not limited to the precise aspects described, and that various other changes and modifications may be effectuated by one skilled in the art without departing from the scope or spirit of the disclosure. Additionally, it is envisioned that the elements and features illustrated or described in connection with one exemplary aspect may be combined with the elements and features of another without departing from the scope of this disclosure, and that such modifications and variations are also intended to be included within the scope of this disclosure. Indeed, any combination of any of the disclosed elements and features is within the scope of this disclosure. Accordingly, the subject matter of this disclosure is not to be limited by what has been particularly shown and described.

What is claimed is:

1. A composite wall module system, comprising:

a first composite wall module including:

a first pair of faceplates;

a first set of cross-ties extending between the first pair of faceplates; and a first side plate extending between the first pair of faceplates;

a second composite wall module including:

a second pair of faceplates;

a second set of cross-ties extending between the second pair of faceplates; and a second side plate extending between the second pair of faceplates;

wherein the first and second composite wall modules are separated by a vertical joint that interfaces the first and second composite wall modules, and wherein the faceplates of the first and second composite wall modules are not made continuous across the vertical joint through continuous welding;

fill disposed between the first and second pairs of faceplates of the respective first and second composite wall modules; and at least one reinforcement bar that extends along the first composite wall module transversely across the first set of cross-ties, transversely across the vertical joint, and along the second composite wall module across the second set of cross-ties to join the first and second composite wall modules together, the at least one reinforcement bar includes at least one bottom reinforcement bar and at least one top reinforcement bar, the at least one bottom reinforcement bar disposed on a bottom surface of the first and second composite wall modules, the at least one top reinforcement bar disposed on a top surface of the first and second composite wall modules;

wherein at least one of the first or second side plates defines a plurality of perforations therethrough receiving a plurality of additional reinforcement bars.

2. The composite wall module system of claim 1, wherein at least one of the first or second side plates includes a plurality of anchors extending transversely therefrom.

3. The composite wall module system of claim 1, further comprising connection elements secured to the first and second pairs of faceplates to couple the first and second composite wall modules together.

4. The composite wall module system of claim 3, wherein the connection elements are secured together by bolting and/or welding.

5. The composite wall module system of claim 1, further comprising additional fill disposed between adjacent module side plates of the first and second pairs of side plates that has different properties than the fill, disposed adjacent to at least one of the first or second sets of cross-ties.

6. The composite wall module system of claim 1, wherein at least one of the first or second side plates further defines an opening therethrough separate from the plurality of perforations, the opening positioned to enable the fill to pass therethrough.

7. The composite wall module system of claim 6, wherein at least one of the faceplates of the first pair of faceplates defines an access opening therethrough that provides access to the plurality of additional reinforcement bars.

8. The composite wall module system of claim 1, further comprising a third composite wall module coupled to the second composite wall module.

9. The composite wall module system of claim 8, wherein the third composite wall module is transverse to the second composite wall module.

10. The composite wall module system of claim 8, wherein the third composite wall module includes an end termination plate.

11. A composite wall module system comprising:

a first composite wall module including:

a first pair of faceplates;

a first set of cross-ties extending between the first pair of faceplates; and a first side plate extending between the first pair of faceplates;

a second composite wall module including:

a second pair of faceplates;

a second set of cross-ties extending between the second pair of faceplates; and a second side plate extending between the second pair of faceplates;

wherein the first and second composite wall modules are separated by a vertical joint that interfaces the first and second composite wall modules, and wherein the faceplates of the first and second composite wall modules are not made continuous across the vertical joint through continuous welding;

fill disposed between the first and second pairs of faceplates of the respective first and second composite wall modules; and a vertical reinforcement bar assembly supported in the vertical joint between side plates of the first and second wall modules, the vertical reinforcement bar assembly including a first vertical reinforcement bar, the first vertical reinforcement bar having a first end segment and a second end segment that are vertically oriented and extend substantially parallel to at least one of the first and second pair of faceplates and to at least one of the first and second side plates, the first and second end segments connected by at least one angled segment between the first and second end segments, the at least one angled segment being transverse to the first and second end segments.

12. The composite wall module system of claim 11, wherein the vertical reinforcement bar assembly includes a second reinforcement bar.

13. The composite wall module system of claim 12, wherein the second reinforcement bar includes a plurality of straight segments and a plurality of angled segments disposed between the plurality of straight segments.

14. A composite wall module system comprising:

a first composite wall module including:

a first pair of faceplates;

a first set of cross-ties extending between the first pair of faceplates; and a first side plate extending between the first pair of faceplates;

a second composite wall module including:

a second pair of faceplates;

a second set of cross-ties extending between the second pair of faceplates; and a second side plate extending between the second pair of faceplates;

wherein the first and second composite wall modules are separated by a vertical joint that interfaces the first and second composite wall modules, and wherein the faceplates of the first and second composite wall modules are not made continuous across the vertical joint through continuous welding;

at least one fill disposed between the first and second pairs of faceplates of the respective first and second composite wall modules; and a plurality of vertical reinforcement bars supported in the vertical joint between the first and second side plates of the first and second wall modules, each vertical reinforcement bar being spaced from and independent of other vertical reinforcement bars of the plurality of vertical reinforcement bars and including at least one angled segment disposed between a pair of end segments;

wherein each end segment of the pair of end segments extends substantially parallel to at least one of the first and second pair of faceplates and to at least one of the first and second side plates.

15. The composite wall module system of claim 14, wherein at least one of the first or second side plates includes a plurality of anchors extending transversely therefrom.

16. The composite wall module system of claim 14, further comprising connection elements secured to the first and second pairs of faceplates to couple the first and second composite wall modules together.

17. The composite wall module system of claim 16, wherein the connection elements are secured together by bolting and/or welding.

18. The composite wall module system of claim 14, further comprising a third composite wall module coupled to the second composite wall module.

* * * * *